US009427769B2

(12) United States Patent
Nicolulis

(10) Patent No.: US 9,427,769 B2
(45) Date of Patent: Aug. 30, 2016

(54) MODULAR WALL PAINTING AND PRINTING SYSTEMS AND DEVICES

(71) Applicant: Joseph Nicolulis, Tualatin, OR (US)

(72) Inventor: Joseph Nicolulis, Tualatin, OR (US)

( * ) Notice: Subject to any disclaimer, the term of this patent is extended or adjusted under 35 U.S.C. 154(b) by 219 days.

(21) Appl. No.: 14/186,311

(22) Filed: Feb. 21, 2014

(65) Prior Publication Data

US 2014/0234006 A1 Aug. 21, 2014

Related U.S. Application Data

(60) Provisional application No. 61/767,635, filed on Feb. 21, 2013.

(51) Int. Cl.
*B05C 17/02* (2006.01)
*B05C 17/035* (2006.01)

(52) U.S. Cl.
CPC ..... *B05C 17/0355* (2013.01); *B05C 17/0232* (2013.01); *B05C 17/0357* (2013.01)

(58) Field of Classification Search
CPC ..... B05C 17/023; B05C 17/0232; B05C 17/0355; B05C 17/0357
USPC ..... 401/35, 218, 219; 15/230.11, 236.03
See application file for complete search history.

(56) References Cited

U.S. PATENT DOCUMENTS 3,036,327 A * 5/1962 Crawford ..... B05C 17/0341 401/15
5,615,444 A * 4/1997 Reye ..... B05C 17/02 101/375

* cited by examiner

*Primary Examiner* — Jennifer C Chiang
*Assistant Examiner* — Joshua Wiljanen
(74) *Attorney, Agent, or Firm* — Mohr Intellectual Property Law Solutions, PC

(57) ABSTRACT

The present disclosure is directed to modular painting devices for painting and/or printing a surface. In some examples, the modular painting devices include a paint cartridge and a handle attached to a roller assembly. The roller assembly includes a housing and one or more rollers rotatably attached to the housing. The one or more rollers are configured to receive paint from the paint cartridge and transfer paint to the surface. In some further examples, the one or more rollers includes an inner roller and an outer roller.

1 Claim, 10 Drawing Sheets

MODULAR WALL PAINTING AND PRINTING SYSTEMS AND DEVICES

CROSS REFERENCE TO RELATED APPLICATIONS

This application claims priority to U.S. Provisional Application, Ser. No. 61/767,635, filed on Feb. 21, 2013, which is hereby incorporated by reference for all purposes.

BACKGROUND

The present disclosure relates generally to painting and printing systems and devices for a wall. In particular, devices for decorative printing and/or painting of surfaces and more particularly, modular wall print roller systems and devices are described.

Known wall painting and/or relief printing devices are not entirely satisfactory for the range of applications in which they are employed. For example, existing paint rollers and wall printing devices are expensive, complicated to use, and lack in versatility of use. Further, in another example, existing wall painting and/or relief printing devices are difficult to use or incapable of use when painting and/or printing in corners and along edges. In this example, a user is required to hand paint the blank areas, hand stamp the blank areas, and/or cover the blank areas with wood trim.

In even another example, conventional wall painting devices do not enable users to conveniently exchange rollers for a roller with a different pattern. Further, the paint applying surface area of painting/relief printing devices is not readily adjustable. Moreover, conventional painting/relief printing devices have messy and cumbersome mechanism to deliver paint to patterned paint rollers mounted in the devices.

Thus, there exists a need for paint roller devices that improve upon and advance the design of known paint rollers, and provide for a versatile device for decorative painting or printing on walls or other surfaces with multiple prints or patterns and in multiple colors. Examples of new and useful modular wall printing devices relevant to the needs existing in the field are discussed below.

SUMMARY

The present disclosure is directed to a modular painting device for painting and/or printing a surface. In some examples, the modular painting device includes a paint cartridge and a handle attached to a roller assembly. The roller assembly includes a housing and one or more rollers rotatably attached to the housing. The one or more rollers are configured to receive paint from the paint cartridge and transfer paint to the surface. In some further examples, the one or more rollers includes an inner roller and an outer roller.

DETAILED DESCRIPTION

Figure 1:
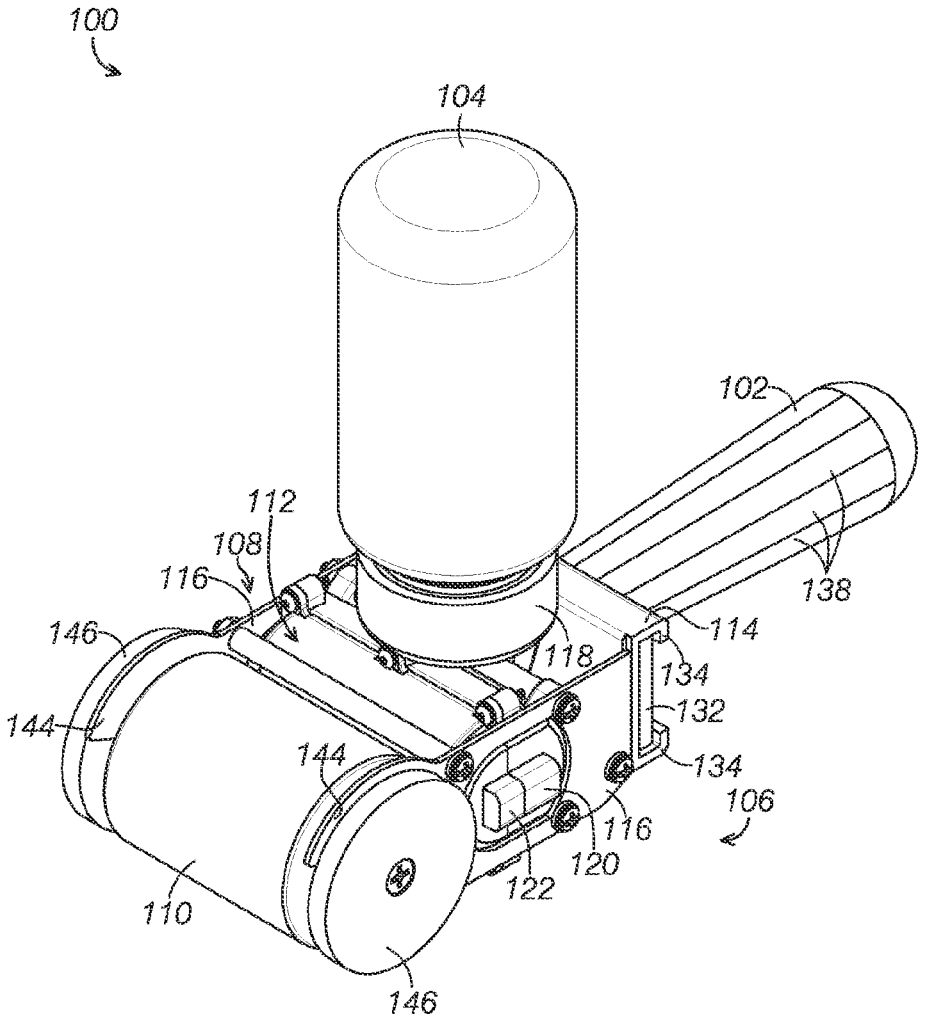
FIG. 1 is a perspective view of a first example of a modular painting device.
Figure 2B:
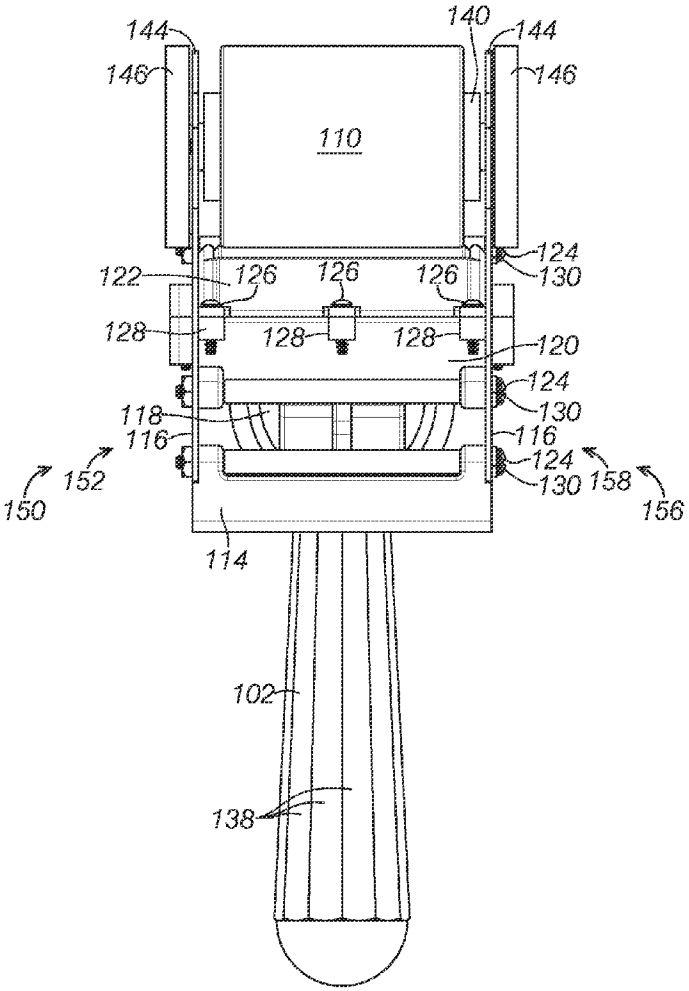
FIGS. 2A and 2B are top plan and bottom plan views, respectively, of the modular painting device shown in FIG. 1.
Figure 2A:
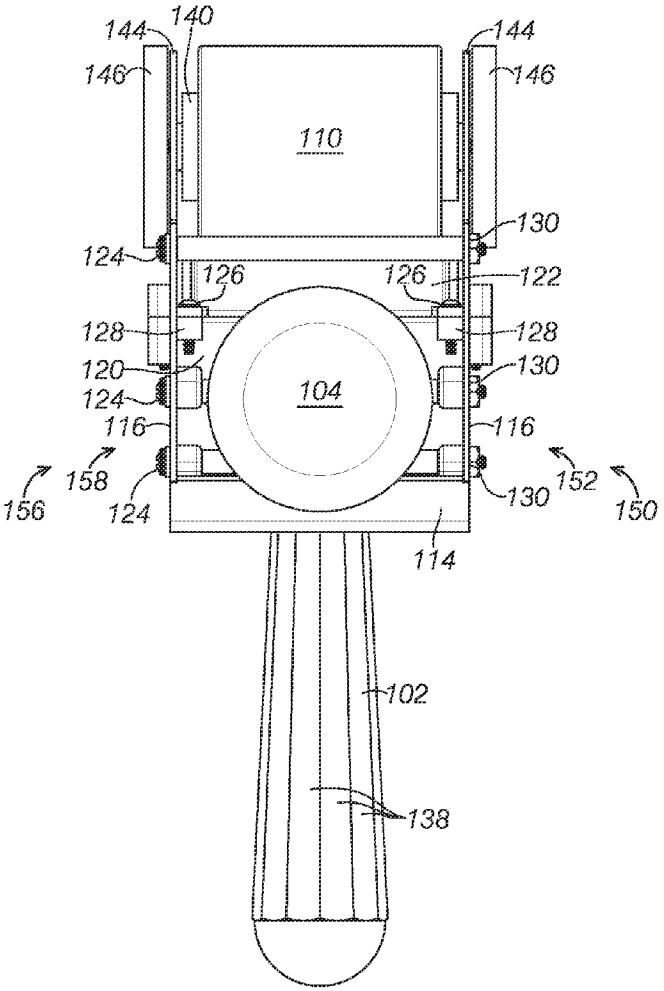
Figure 3B:
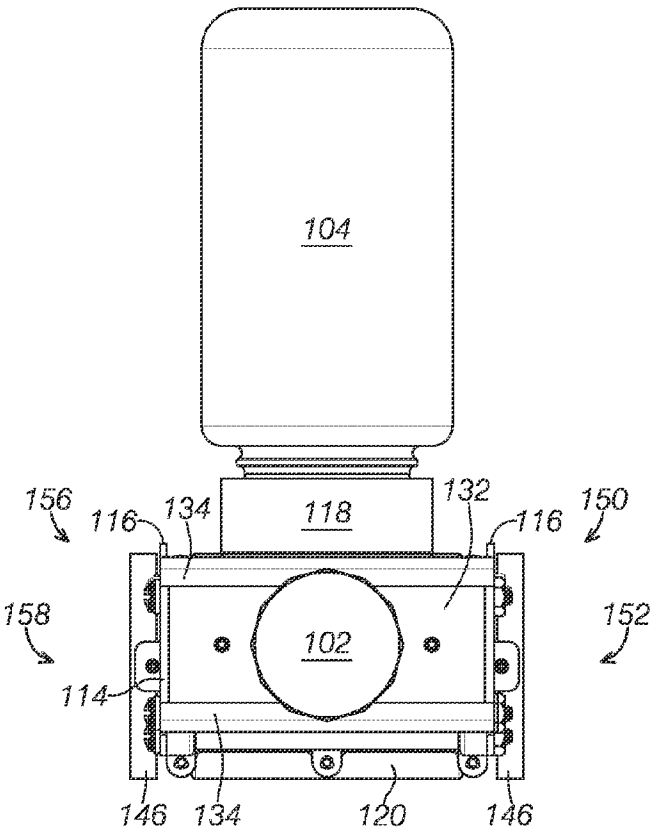
FIGS. 3A and 3B are front plan and rear plan views, respectively, of the modular painting device shown in FIG. 1.
Figure 3A:
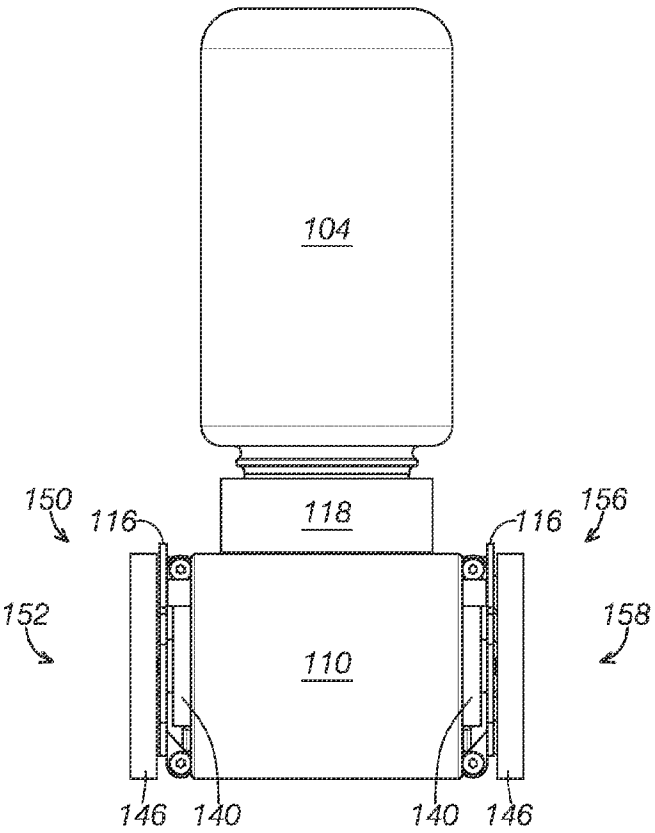

The disclosed modular wall printing and/or painting devices and systems will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various modular wall printing and/or painting devices and systems are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

With reference to FIGS. 1-5, a first example of a modular painting device, modular painting device 100, will now be described. Modular painting device 100 includes a handle 102, a paint cartridge 104, and a roller assembly 106. Roller assembly 106 includes a housing 108, an outer roller 110, and an inner roller 112. Outer roller 110 and inner roller 112 are rotatably attached to housing 108. Inner roller 112 is configured to receive paint from paint cartridge 104 and transfer paint to outer roller 110. Outer roller 110 is configured to receive paint from inner roller 112 and transfer paint to a desired surface, such as a wall. Thus, the modular painting device can be used to continuously paint the desired surface without stopping to dip/submerge the rollers in paint.

Figure 8B:
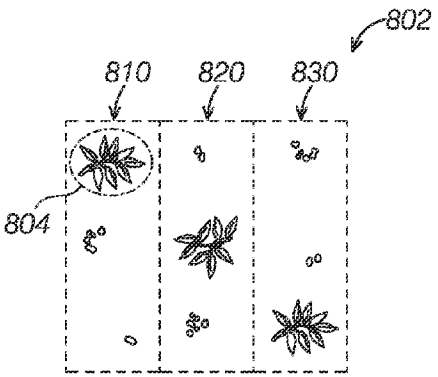
FIGS. 8A and 8B are example wall printing patterns that can be made using the modular painting device of FIG. 1 and/or the three coupled modular painting devices of FIG. 6.
Figure 8A:
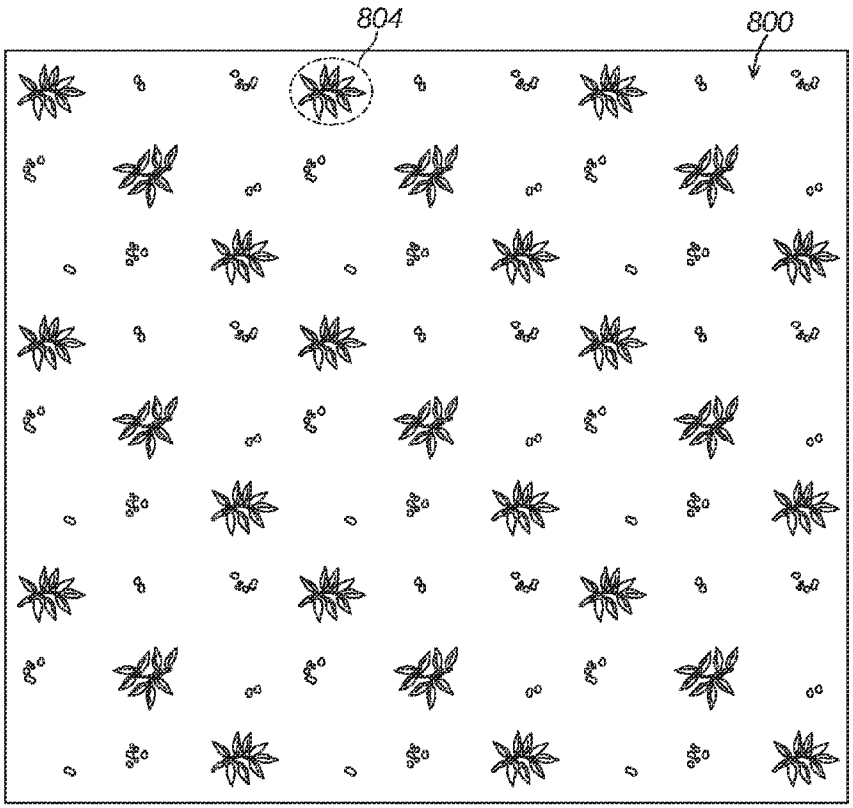

In some examples, outer roller 110 can include a relief pattern (i.e., a raised pattern). In this example, outer roller 110 is configured to receive paint from inner roller 112 onto the relief pattern and transfer paint from the relief pattern onto the desired surface. Thus, the modular painting device can be used to paint a relief print on the desired surface. An example relief print that can be created using modular painting device 100 is shown in FIG. 8A. In some examples, outer roller 112 is releasably attached to housing 108 and thus the outer roller can be exchanged for a different outer roller (e.g., a smooth roller can be exchanged for a roller with a relief pattern).

Figure 6:
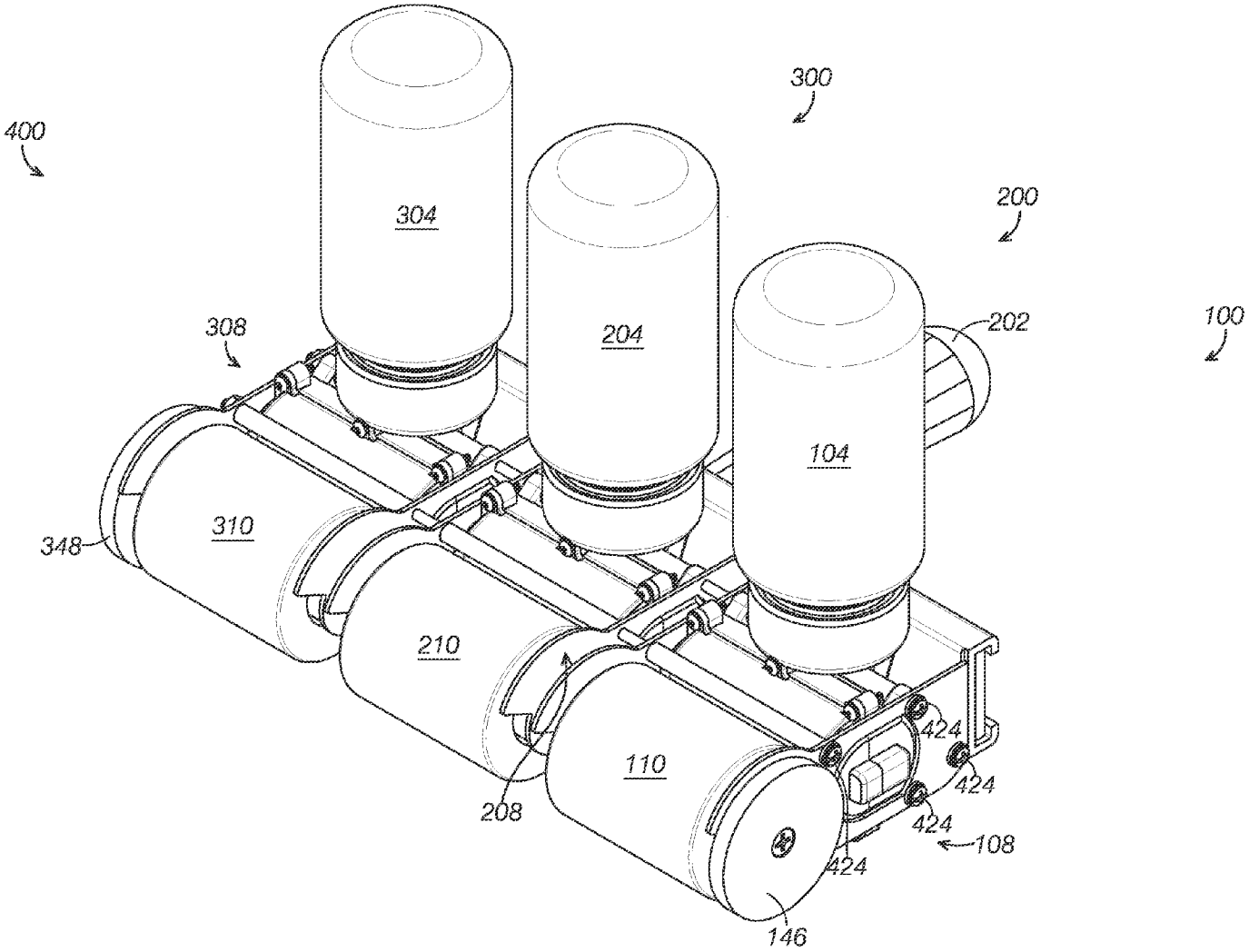
FIG. 6 is a perspective view of the modular painting device of FIG. 1 coupled to two additional modular painting devices having an identical configuration.
Figure 7A:
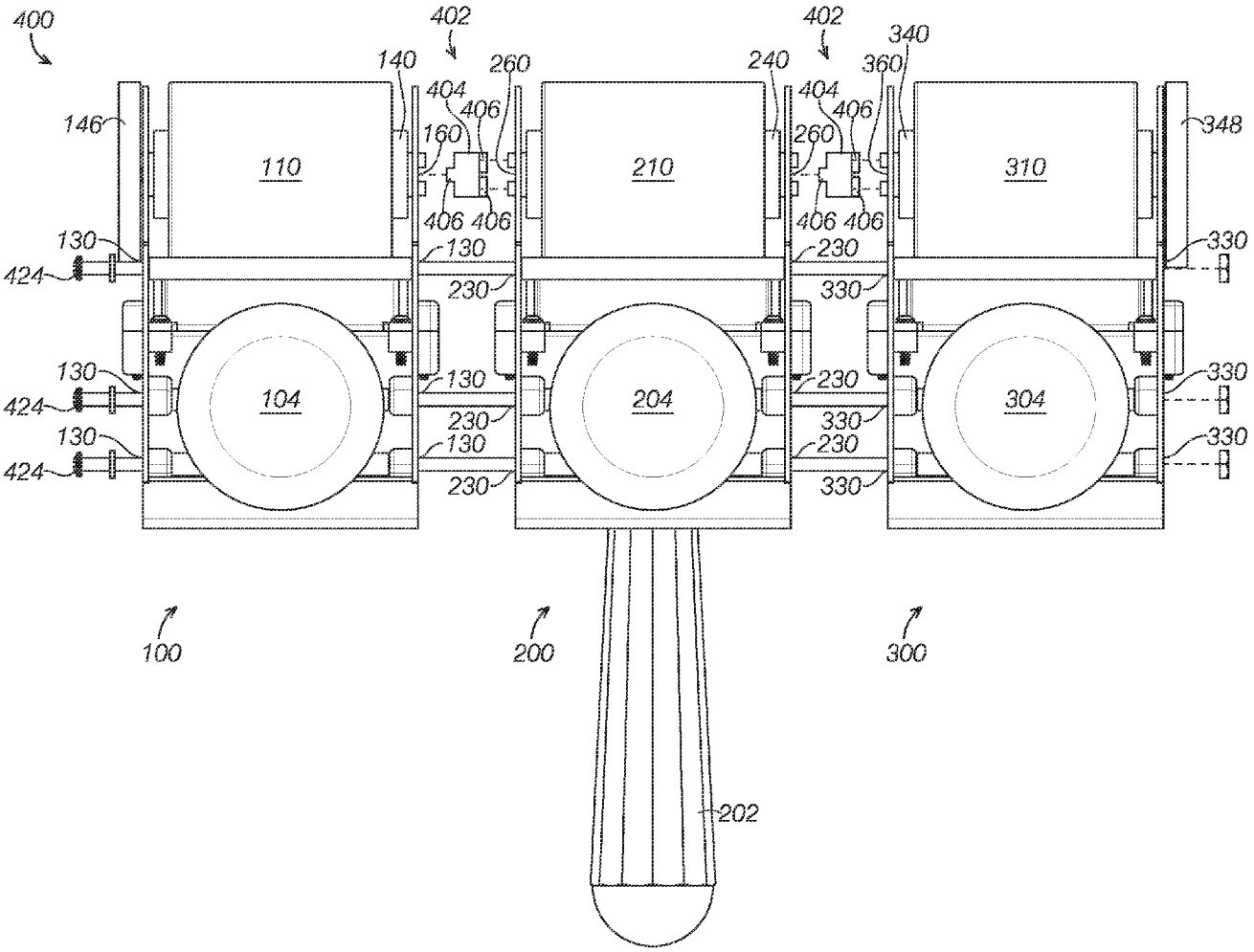
FIGS. 7A and 7B are top plan views of the three modular painting devices of FIG. 6 in an uncoupled position and a coupled position, respectively.
Figure 7B:
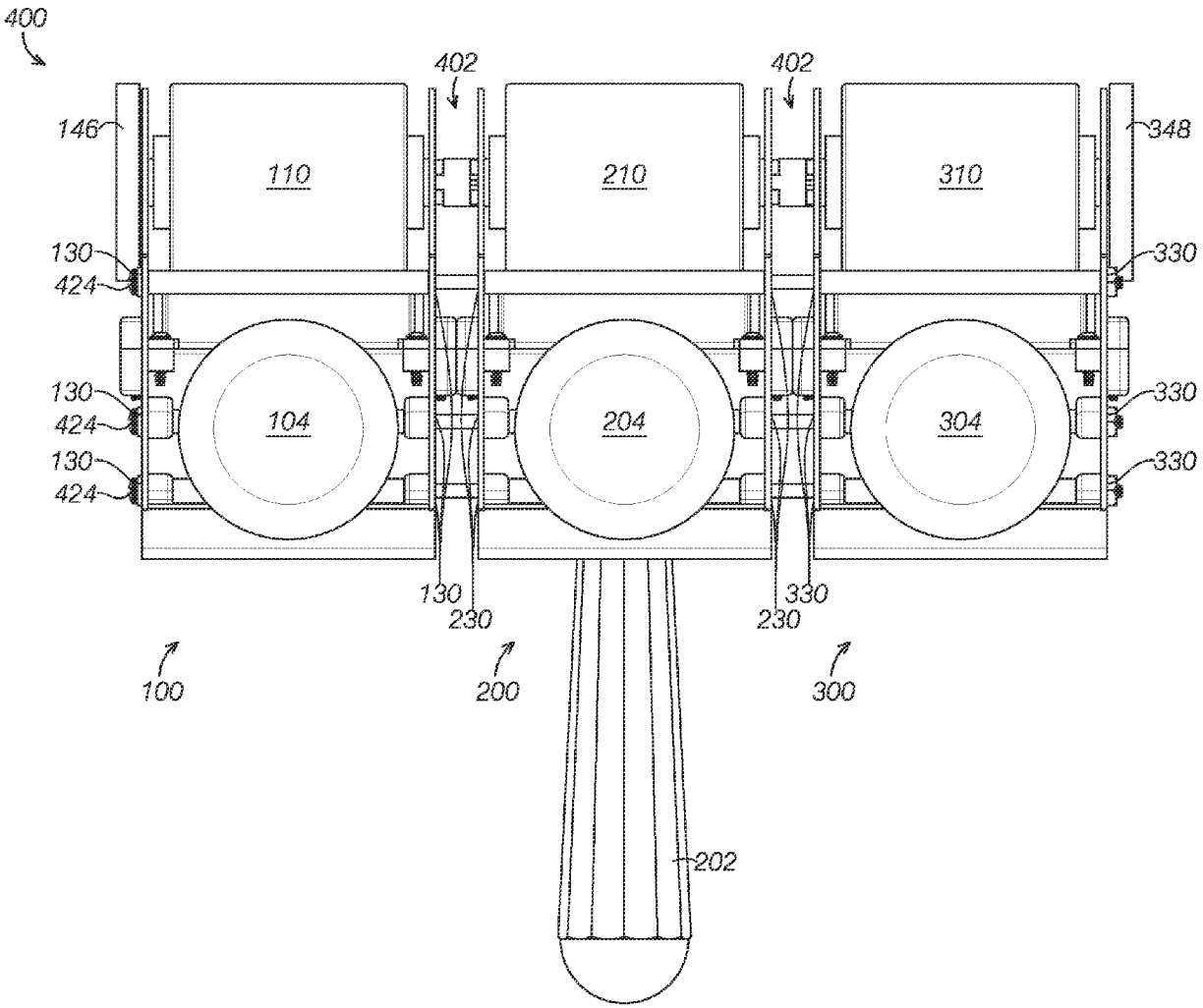

As shown in FIGS. 6-7B, modular painting device 100 can be coupled to and used in combination with one or more other modular painting devices, such as modular painting devices 200 and 300, forming a modular painting device assembly 400. In this example, the painting transferring surface area is easily increased by a user, greatly reducing the time required to cover a surface with paint. In some examples, the outer rollers can be attached via a roller attachment mechanism so that the outer rollers are cooperatively rotatable.

Figure 9:
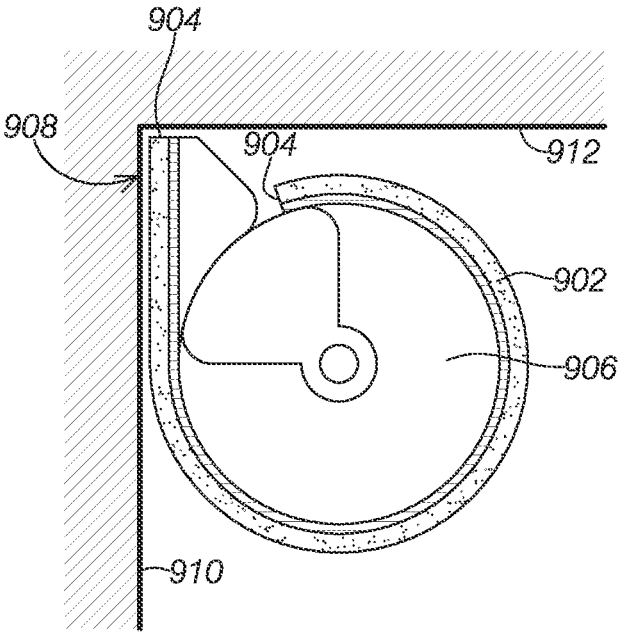
FIG. 9 is a cross-sectional view of an example outer roller having an at least partially detachable relief pattern that may be used with the modular painting devices of FIGS. 1-7B.

In additional or alternative examples, outer rollers 110, 210, and 310 can each include a relief pattern. In these examples, the outer rollers can be attached via a roller attachment mechanism so that the outer rollers are cooperatively rotatable. In order to create a desired pattern, the outer rollers can be locked into or attached into an offset position. In some specific examples, the outer rollers are attached in a position where each of the outer rollers is offset by 120° relative to an adjacent roller. FIG. 8A shows an example relief print 800 on surface. FIG. 8B shows an example single rotation relief print 802 created by three outer rollers offset by 120° relative to an adjacent roller. FIGS. 9 and 10 include an example outer roller with a detachable relief that may be used with the modular painting devices of FIGS. 1-7B.

Thus, the presently described modular wall painting and/or printing devices and systems can be used to paint and/or relief print a surface, and address many of the above identified limitations of conventional painting/printing devices. The modular painting devices can be easily coupled and used in combination with one or more other modular painting devices (i.e., modular painting device assembly). In these examples, the painting/printing applying surface area is increased and therefore the time required for covering a surface is reduced. Alternatively or additionally, a single device can be used to paint/print smaller areas (e.g., corners, edges, etc.).

Further, the presently described modular wall painting and/or printing devices and systems allow for paint to be consistently fed to the roller while painting and/or printing, making the painting and/or printing process easier and faster for a user. Furthermore, different colored paints (i.e., adjacent paint cartridges having different colors of paint) and/or relief patterns can be used in a coupled roller assembly (i.e., two or more modular painting devices used in combination).

Further still, the presently described modular wall painting and/or printing devices and systems are dynamic and versatile, having the ability to be alternately used with different rollers (e.g., smooth, textured, various relief patterns, etc.), different colors (e.g., red paint cartridge, yellow paint cartridge, green paint cartridge, etc.), and different painting/printing surface areas (e.g., one device, two coupled devices, three coupled devices, etc.).

As described above and shown in FIGS. 1-5, modular painting device 100 includes handle 102, paint cartridge 104, and roller assembly 106. Roller assembly 106 includes housing 108, outer roller 110, and inner roller 112. Housing 108 includes a rear wall 114, a pair of opposing side walls 116, a paint cartridge attachment port 118, a rearward casing 120, a forward casing 122, lateral fastening members 124, and longitudinal fastening members 126.

In the present example, rear wall 114, attachment port 118, and rearward casing 120 are one piece. In alternate examples, the rear wall, attachment port, and rearward casing may be separate pieces that are attached via an attachment mechanism (e.g., fastening members, adhesive, etc.). Forward casing 122 is attached to rearward casing 120 via attachment members 126 inserted through holes 128. Holes 128 are extended through rearward casing 120 and forward casing 122. In this example, attachment members 126 are shorter threaded attachment members. It will be appreciated that in other examples, one or more of attachment members 126 can be substituted with any suitable attachment mechanism, such as a snap-fit mechanism, slide-fit mechanism, etc.

Side walls 116 are attached to rear wall 114, rearward casing 120, and forward casing 122 via attachment members 124 inserted through holes 130. Holes 130 are each extended through side walls 116 and one of rear wall 114, rearward casing 120, and forward casing 122. In this example, attachment members 124 are longer threaded attachment members. It will be appreciated that in other examples, one or more of attachment members 126 can be substituted with any suitable attachment mechanism, such as a snap-fit mechanism, slide-fit mechanism, etc.

As depicted in FIGS. 1-5, handle 102 has a generally straight and tapered shape, being narrower at an end proximal to rear wall 114 and wider at an opposing end and extending straight behind roller assembly 106. Handle 102 further includes longitudinal facets 138 that provide a gripping surface on the handle. It will be appreciated that the handle may have some other desired configuration. For example, the handle may include a finger-shaped gripping surface and/or a gripping surface with circular-shaped depressions or protrusions. Further, in other example, the handle can have a different length and/or inclination (i.e., the handle may be disposed at an angle relative to the roller assembly).

Figure 4A:
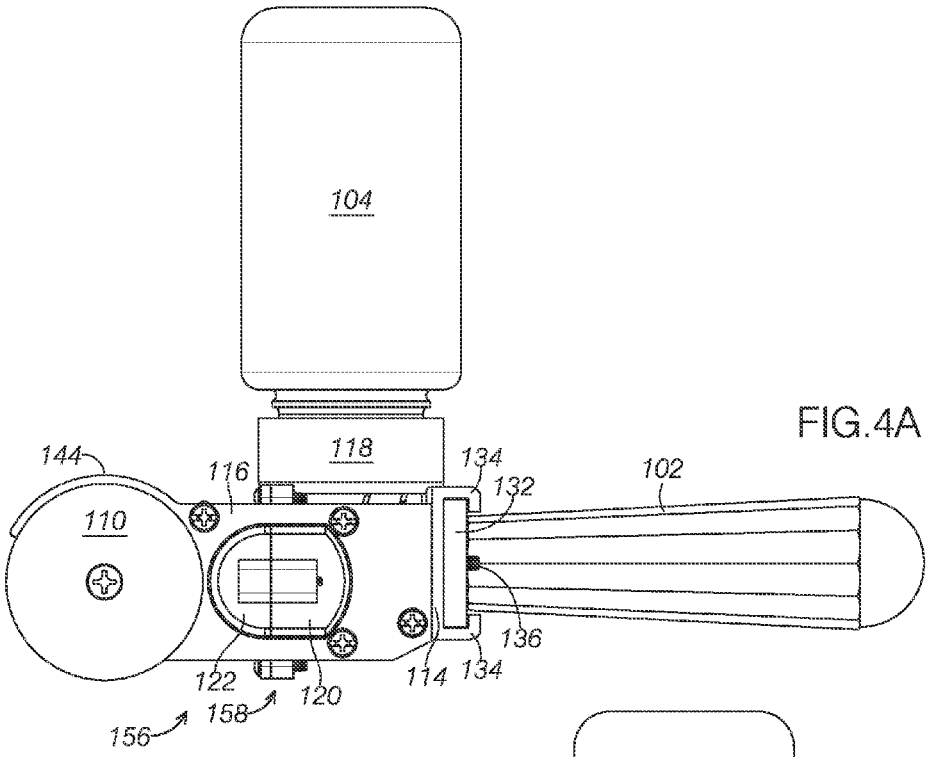
FIGS. 4A and 4B are first lateral side plan and second lateral side plan views, respectively, of the modular painting device shown in FIG. 1.
Figure 4B:
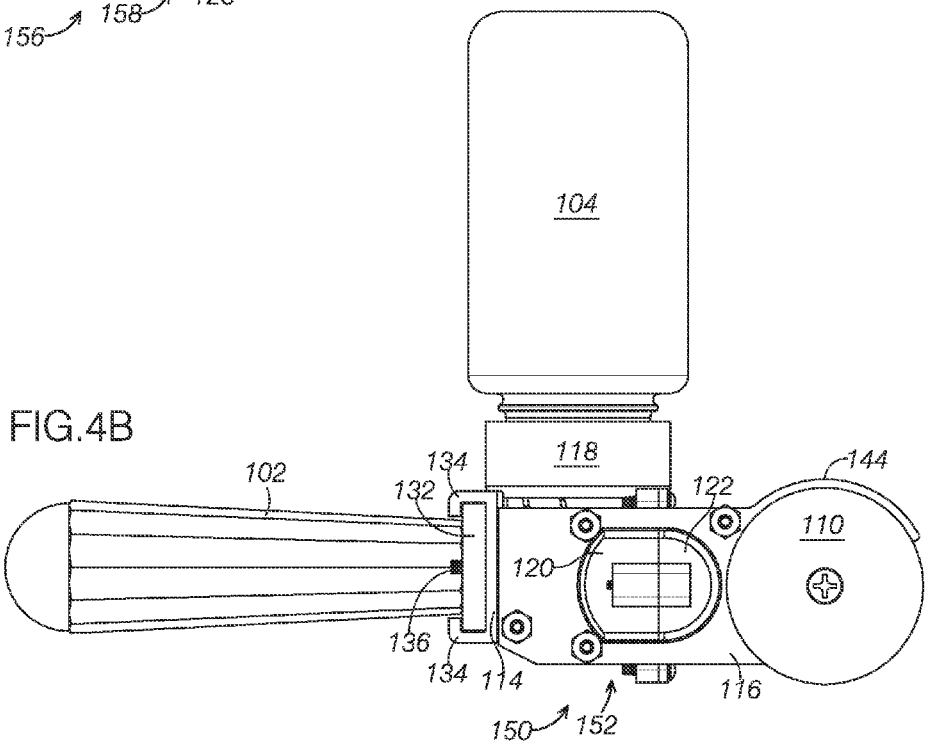
Figure 5:
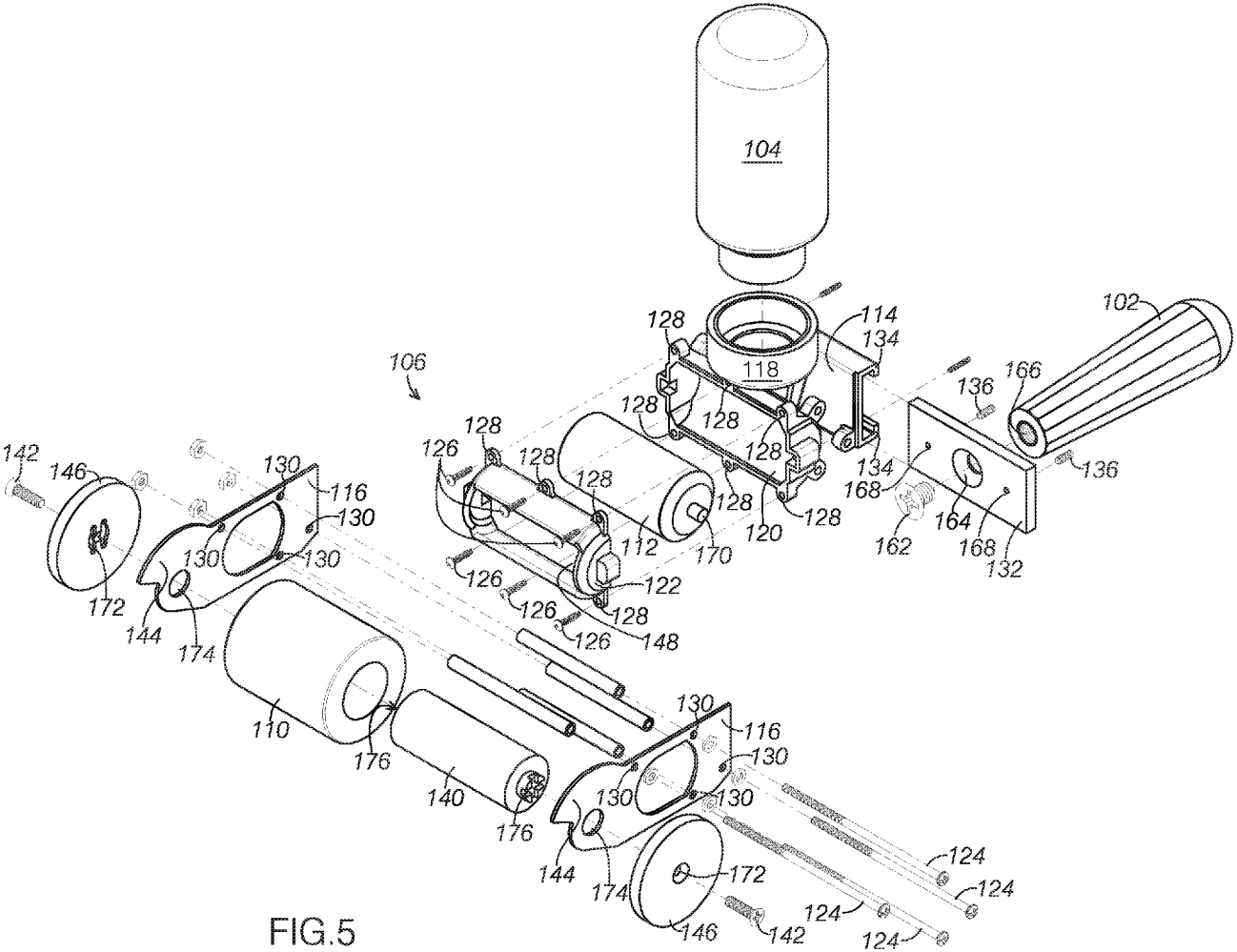
FIG. 5 is an exploded view of the modular painting device shown in FIG. 1.

As shown in FIGS. 4A and 4B, rearward wall 114 is configured to attach to/retain handle 102. More specifically, handle 102 includes an end plate 132 that is slide fit through rearward extending flanges 134 of rear wall 114. As shown in FIG. 5, end plate 132 is attached to handle 102 via a threaded attachment member 162 inserted through an end plate hole 164 and fitted into complimentarily configured hole 166. In alternate examples, the end plate may be integrally formed with the handle.

End plate 132 is secured to rearward wall 114 by fastening members 136. In the present example, fastening members 136 are threaded fastening members that fit into complimentarily configured holes 168 in rearward wall 114 (shown in FIG. 5). In other examples, fastening members 136 can be any suitable fastening members, such as spring-biased pins, snap-fit fastening members, etc.

Further, in additional alternate examples, the handle can be attached to the roller assembly by a different attachment mechanism. For example, the handle may include a threaded end and the roller assembly housing may include a complimentarily configured hole for receiving the threaded end of the handle. It will be appreciated that in the above described examples, the handle is releasably attached to the roller assembly.

In these examples, the handle may be removed and/or changed out for a different handle (e.g., a handle having one or more of a different inclination, shape, grip, length, etc.). Further, in some examples, a specialized handle can be used (e.g., a handle including bubble or laser level). In other examples, the handle may not be releasable and may be permanently attached to the roller assembly. For example, the handle may be integral to the rear wall.

Paint cartridge 104 is attached to roller assembly 106 via attachment port 118. In the present example, paint cartridge 104 is attached to a top of roller assembly 106. Paint cartridge 104 holds a paint supply (now specifically shown). As the paint cartridge is directly attached to the device to provide a continuous paint supply, the modular painting device can be used to continuously paint the desired surface without stopping to dip/submerge the rollers in paint.

The paint cartridge can be self-contained and supply paint into roller assembly 106 via a control feed system. The control feed system may be any system that is suitable for supplying only enough paint to prime and/or re-prime the outer roller as it moves over a surface (i.e., paints and/or prints a surface). Further, the control feed system allows for modular painting device 100 to be used in various desired positions without leaking, while providing a consistent painted/relief print application.

In one example for a control feed system, the paint cartridge is snap-fitted into the attachment port to create a seal with the port and the casing for the inner roller. Depending on the viscosity of the paint in the paint supply, the inner roller clearance can be adjusted to create a sufficient seal and flow of paint. In one specific example, gravity is used to generate a flow of paint. In other examples, a pressurized system and a microswitch can be used to generate the flow of paint.

In the present example, paint cartridge 104 is releasably and sealably attached to attachment port 118. Paint cartridge 104 can be attached to attachment port 118 via a suitable releasable attachment mechanism, such as a snap-fit attachment mechanism or threaded attachment mechanism. In an alternative example, the housing and paint cartridge are integrally formed and the paint cartridge can be filled via a sealable-opening. In one example, a paint cartridge is permanently fixed to the housing and includes a threaded top that may be opened to fill the paint cartridge.

The paint cartridge can be reusable, or a single-use disposable paint cartridge. Paint cartridges may be a clear transparent container to enable a user to see the pre-mixed shades of color for direct color matching of decor. In addition, paint cartridges can be leak-proof and vented as to not create a vacuum.

In the present example, paint cartridge 104 has a generally cylindrical shape. It will be appreciated that the paint cartridge may be of any suitable shape. For example, the paint cartridge may have an irregular shape. In other examples, the paint cartridge may have a cuboid or rectangular cuboidal shape. Further, the paint cartridge may be may be collapsible as the paint supply is emptied through use. Furthermore, the paint cartridge may include an insertable collapsible bladder in which a paint supply is provided.

In any of the above examples, a color of the paint supply is selectable by a user. Further, the paint supply may be selectively changed by a user to change the color and/or re-fill the paint supply. In some examples, the modular painting device may incorporate a controlled feed system which injects paint from multiple paint cartridges through a rotary valve in the side of the roller into a plurality of closed canals.

In these examples, multiple colors are fed through to the rollers to precise locations on the prints, printing multiple colors simultaneously. For example, when a flowered print with interlaced vines and leaves is provided, the flowers will print red, the vines beige, and the leaves green. The multicolor system can use standard paint cartridges each attached to one of multiple attachment ports, or a handheld backpack paint supply feed system fluidly coupled to the housing via tubes.

The multicolor system may also use a static feed paint head to apply paint to a pattern. The example, the static feed paint head, or multiple paint heads, may apply red paint to a flower portion of a pattern, a beige color for a vine portion of the pattern, and a green color to a leaf portion of the pattern. Any currently known or later developed static feed paint head may be used.

Paint cartridge 104 and attachment port 118 are configured to provide paint to inner roller 112 that is housed in rearward casing 120 and forward casing 122. Inner roller 112 is configured to receive paint from paint cartridge 104 and transfer paint to outer roller 110. Outer roller 110 is configured to receive paint from inner roller 112 and transfer paint to a desired painting surface.

As state above, inner roller 112 is rotatably attached to housing 108. In the present example, inner roller 112 is rotatably attached to housing 108 via an axel 170 (shown in FIG. 5) within rearward casing 120 and forward casing 122. The inner roller is provided within the rearward and forward casings so that the paint supply flowing from the paint cartridge is contained within the casing during operation of the modular paint roller. In alternate examples, the inner roller can be free within the casings (i.e., not attached to an axle) and be of a slightly smaller size than the casing (i.e., the combined rearward and forward casings). In these examples, the inner roller is rotatably attached to the housing by being contained within casing.

Also stated above, outer roller 110 is rotatably attached to housing 108. In the present example, outer roller 110 is attached to housing 108 via an axel 140. Axel 140 is attached to opposing side walls 116 via attachment members 142. In the present example, attachment members 142 are threaded attachment members fitted through wheel holes 172, side wall holes 174, and complimentarily configured axel holes 176. It will be appreciated that in other examples, the outer roller axel may be attached via attachment members having any of the above described configurations for attachment members.

In the present example, outer roller 110 is rotatably and releasably attached to the housing so that a desired outer roller can be used (e.g., an outer roller having a desired texture and/or relief pattern). In alternative examples, the outer roller can be substantially non-releasable and an outer layer relief pattern or textured surface can be releasably attached to the outer roller (as depicted in FIG. 9). Additionally or alternatively, in some examples, the outer roller can further incorporate an embedded gripping system which will be integral in the relief surface to provide positive traction on slick or glossy painted background surface.

Each of opposing side walls 116 includes a curved projection 144 that partially extends around opposing ends of outer roller 110. Each of a pair of wheels 146 are rotatably attached to axel 140 on opposing outer surfaces of side walls 116. Wheels 146 are configured to provide traction and consistent contact with the surface that is being painted and/or relief printed. In alternate examples, the wheels may be excluded from the device so that the outer roller is the only portion of the modular painting device that makes contact with the surface. In other alternate examples, the curved projections may be excluded from the device.

A slotted opening 148 is disposed in forward casing 122 so that inner roller 112 is exposed. The exposed region of inner roller 112 (i.e., a portion of inner roller 112 that protrudes through slotted opening 148) contacts outer roller 110. As outer roller 112 moves over a surface, rotation of the outer roller drives rotation of inner roller 112. Thus, operation/rotation of the outer roller during use of the modular painting device facilitates transfer of paint from the paint cartridge to the inner roller and from the inner roller to the outer roller.

As shown in FIGS. 2A-7B, modular painting device 100 can include a mechanism for attachment of other modular painting devices, such as modular painting devices 200 and 300. Accordingly, an outer surface 150 of housing 108 is a first coupling side 152 (e.g., a first coupling partner). In the present example, first coupling side 152 can include a male coupling partner. More specifically, fastening members 124 can be replaced with longer fastening members, such as fastening 424, that are extended past side wall 116 when inserted through holes 130, and the longer fastening members can be a male coupling partner. An outer surface 156 is a second coupling side 158. In the present example, second coupling side 158 can include a female coupling partner. More specifically, the female coupling partner can be holes 130 for receiving the longer attachment member.

The coupling partners are provided for attachment of additional modular painting devices, such as modular painting devices 200 and 300 (shown in FIGS. 6-7B). In the example of FIGS. 1-5, fastening members 124 have a sufficient length to fit/extend through one housing (such as housing 108). In the example of FIGS. 6-7B, fastening members 124 are replaced with other longer fastening members 424 having a sufficient length to be fitted through one or two additional housings, such as housings 212 and 312. The coupling partners are configured to allow two or more modular painting devices to be used in combination, thereby increasing the painting/printing surface area (i.e., multiple outer rollers used in combination).

It will be appreciated that the outer surfaces of the housing may include any suitably configured coupling partners for releasable attachment of modular painting devices. In some examples, the outer surfaces of the housing may include a snap-fit attachment mechanism (i.e., snap-fit male and female coupling partners) that can be coupled to a snap-fit attachment mechanism on an adjacent modular painting device. In other examples, the outer surfaces of the housing may include a twist-fit interlocking mechanism (i.e., twist-fit interlocking male and female coupling partners) that can be couple to a twist-fit interlocking mechanism on an adjacent modular painting device. In yet other examples, the outer surfaces of the housing may include a slide-fit attachment mechanism (i.e., slide-fit male and female coupling partners) that can be coupled to a slide-fit attachment mechanism on an adjacent modular painting device.

Turning now to FIGS. 6-7B, modular painting device assembly 400 will now be described in greater detail. As stated above, modular painting device 100 can be coupled to and used in combination with one or more other modular painting devices, such as modular painting devices 200 and 300, forming modular painting device assembly 400. Specifically, attachment members 424 have a sufficient length to be extended/fitted through three adjacent housings (i.e., housings 108, 208, 308).

As shown in FIG. 7A, in order to create modular painting device assembly 400, modular painting devices 100, 200, 300 are aligned. Further, attachment members 424 are aligned with and inserted through holes 130, 230, and 330. As shown in FIG. 7B, after insertion of attachment members 424, modular painting device assembly can be operated as a single device.

It will be appreciated that in alternate examples, a modular painting device assembly can include two modular painting devices (e.g., modular painting devices 100 and 200). In these examples, the attachment members have a length sufficient to extend through two housings (e.g., housings 108 and 208). It will be further appreciated that in other examples, a modular painting device assembly can include four or more modular painting devices. In these examples, the attachment members will have sufficient length to fit through four or more housings.

In the present example, two of the handles (i.e., handles of modular painting devices 100 and 300) have been removed prior to operation so that only one handle remains attached to a center of modular painting device assembly 400. In this example, handle 202 is gripped by a user for one-handed operation of modular painting device assembly 400. In other examples, handle 202 can be removed and handles of modular painting devices 100 and 300 can remain attached, or all three handles can remain attached. In these examples, the modular painting assembly two of the handles can be gripped by a user for two handed operation.

It will be appreciated that in other examples where only two modular painting devices assembled into a modular painting device assembly (e.g., modular painting devices 100 and 200 only), one of the handles can be removed and the remaining handle can be positioned and fixed in a center of the modular painting device assembly. In this example, the handle is fixed so that the end plate of the handle is partially extended through flanges of adjacent rear walls.

Each of modular painting devices 100, 200, and 300 includes a paint cartridge, paint cartridges 104, 204, and 304, respectively. In some examples, the paint cartridges include the same colored paints in their respective paint supplies. In other examples, the paint cartridges include different colored paints in their respective paint supplies. It will be appreciated that a user can select any desired combination of colors for the paint supplies in each of the paint cartridges.

Using modular painting device assembly 400 the painting transferring surface area is easily increased by a user, greatly reducing the time required to cover and/or relief print a surface with paint. In one specific example, one outer roller has a length 6", and therefore three outer rollers together have a length 18". Additionally, outer rollers with a greater diameter can be used to increase the paint transferring surface area and further reduce the time required to cover and/or relief print a surface with paint. In one specific example, outer rollers with a diameter of 3"can be used instead of outer rollers with a diameter of 2".

In some examples, the outer rollers can be attached via a roller attachment mechanism, such as roller attachment mechanism 402, so that the outer rollers are cooperatively rotatable. In additional or alternative examples, one or more of outer rollers 110, 210, and 310 can include a relief pattern. In these examples, the outer rollers can be attached via roller attachment mechanism 402 so that the outer rollers are cooperatively rotatable and the outer rollers can be selectively locked into or attached into an offset position in order to create a desired pattern.

In the present example, roller attachment mechanism 402 includes roller attachment keys 404. Each of roller keys 404 has three interlock tabs 406 disposed on opposing lateral sides (i.e., two on a first lateral side and one on a second lateral side) that insert into receiving spaces 160, 260, and 360 that are an integral key pattern on an end of the axel 140, 240, and 340, respectively.

Each outer roller can have multiple receiving spaces dispersed at various intervals, for example at 120° and 180° intervals, so that the outer rollers can be attached in an offset position relative to adjacent outer rollers. It will be appreciated that in additional or alternate examples, the roller keys and receiving spaces can have any desired configuration for interlocking and/or offsetting the outer rollers (e.g., interlocking teeth patterns, interlocking curve patterns, etc.).

In this example, the wheels that are proximal to an adjacent modular printing device (i.e., one of the wheels of modular painting device 100 and 300, and both of wheels of modular painting device 200) are removed to allow for attachment of the roller keys. It will be appreciated that the outermost wheels (i.e., one of wheels 148 and 348) remain attached to modular painting device assembly 400 in order to provide traction and consistent contact with the surface that is being painted and/or relief printed.

Offsetting the rollers from one another creates an offset of prints and a uniform diagonal flow across the surface being printed. In some specific examples, the outer rollers are attached in a position where each of the outer rollers is offset by 120° relative to an adjacent roller. FIG. 8B shows an example single rotation relief print 802 created by three outer rollers rotated cooperatively and offset by 120° relative to an adjacent roller.

Specifically, relief print 810 is a single rotation of outer roller 110, relief print 820 is a single rotation of outer roller 210, and relief print 830 is a single rotation of outer roller 310. In this example, the outer rollers are offset so that the pattern is evenly apportioned as the rollers are cooxperatively rotated. Further, modular painting device assembly 400 can be used to create a relief print over a larger surface, such as wall relief print 800 shown in FIG. 8A.

In some examples, a relief pattern can include an individual detachable stamp for creating an individual relief print, such as a stamp relief print 804. In these examples, the individual detachable stamp can be attached to the outer roller via a stamp attachment mechanism. In one example, the stamp attachment mechanism is a snap-fit mechanism. In other examples, the stamp attachment mechanism can be magnetic mechanism, slide-fit mechanism, or any other suitable attachment mechanism.

The detachable stamp can be removed from the roller for relief-printing by hand in areas of the surface that are difficult to reach with the modular painting device. In one specific example, the detachable stamp can be used to relief print a top portion of a wall that is proximal to an intersection between the wall and a ceiling. Further, in some examples, the outer roller including a stamp will be recessed (i.e., have a smaller diameter than outer rollers 110, 210, and 310) to accommodate for a thickness of the detachable stamp and the stamp attachment mechanism.

Additionally, an indexing system may be used to rotate the modular painting device to the starting position for each vertical run, keeping the prints uniform as the surface is printed. When starting a first vertical row, the tops of the paint cartridges and the modular painting device create an offset from a perpendicular surface above to restrict or prevent paint from the roller from touching any surface not intended to be painted and/or relief painted.

In one specific example, shown in FIG. 9, an outer roller 900 having a detachable relief pattern layer 902 can include a seam 904 that allows detaching of the relief pattern from the roller. In one example, the seam is a location of a starting index. Outer roller 900 can be used for relief patterns and/or textures that are continuous patterns and/or textures (i.e., covering a total surface of the outer roller).

In some examples for use of multiple outer rollers 900 in a modular painting device assembly (e.g., modular painting device 400), relief patterns will alternate starting positions for each adjacent outer roller. When the outer roller is indexed in the starting position there will be a ratcheting system (e.g., a cam system) to fold out detachable relief pattern 902 from a quadrant of a roller base 906. The detachable relief pattern can then contact the surface to relief print on a region of the surface above the device.

As shown in FIG. 9, this may be particularly advantageous to relief print a small area that is in the top corner of a surface. Specifically, detachable relief pattern 902 can be at least partially released from roller base 906 and a top portion 908 of a wall 910 that is proximal to an intersection between the wall and a ceiling 912 can be relief printed. In other examples, the detachable relief pattern can be wholly removed from the roller base and used to print the surface by hand.

In another general aspect of the modular painting device, a method for painting and/or printing walls or other surfaces is described. The method comprises the steps of: (a) providing a modular painting device or modular painting device assembly in accordance with the present invention (of any type described herein) with a desired outer roller rotatably attached thereto (e.g., an outer roller having a desired texture and/or relief print); (b) aligning the device on a wall or other surface to be painted and/or printed; (c) rolling the modular painting device or modular painting device assembly along the wall or other surface to be painted and/or printed; (d) realigning the modular painting device or modular painting device assembly adjacent to the prior rolling run and rolling outer roller along the wall or other surface to be printed, and (e) repeating step "(d)" until printing of the wall or surface to be to be printed is completed.

In a further embodiment wherein the modular painting device includes an outer roller with a detachable relief pattern, the method may include the additional steps of (t) partially or wholly removing the design print from the modular painting device; (g) identifying one or more areas of the wall or other surface which are too small or narrow for the device to relief print; and (h) in a case where the relief print is wholly removed, applying the pattern on the design print to the identified one or more areas of the wall or other surface by hand.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A modular painting device painting system, comprising:

a first modular painting device, the first modular painting device having:

a first paint cartridge;

a first handle; and a first roller assembly, the first paint cartridge and the first handle being attached to the first roller assembly, the first roller assembly being a first housing, the first housing having a first female coupling partner and a first male coupling partner, each of the first female coupling partner and the first male coupling partner being on opposing lateral sides of the first housing, a first inner roller rotatably attached to the first housing, and a first outer roller rotatably attached to the first housing, the first inner roller configured to receive paint from the first paint cartridge and transfer paint to the first outer roller, the first outer roller configured to receive paint from the first inner roller and transfer paint to the surface; and a second modular painting device, the second modular painting device having:

a second paint cartridge;

a second handle; and a second roller assembly, the second paint cartridge and the second handle being attached to the second roller assembly, the second roller assembly being a second housing, the second housing having a second female coupling partner and a second male coupling partner, each of the second female coupling partner and the second male coupling partner being on opposing lateral sides of the second housing, a second inner roller rotatably attached to the second housing, and a second outer roller rotatably attached to the second housing, the second inner roller configured to receive paint from the second paint cartridge and transfer paint to the second outer roller, the second outer roller configured to receive paint from the second inner roller and transfer paint to the surface, wherein the first female coupling partner is configured to be releasably coupled to the second male coupling partner and the first outer roller is configured to be selectively attached to the second outer roller, the first outer roller and the second outer roller being cooperatively rotatable when attached.

* * * * *